United States Patent [19]

Hoshi et al.

[11] Patent Number: 4,869,074

[45] Date of Patent: Sep. 26, 1989

[54] REGENERATIVE REFRIGERATION CYCLE APPARATUS AND CONTROL METHOD THEREFOR

[75] Inventors: Takao Hoshi, Fuji; Keiichi Morita, Fujinomiya, both of Japan

[73] Assignee: Kabushiki Kaisha Toshiba, Kawasaki, Japan

[21] Appl. No.: 200,053

[22] Filed: May 27, 1988

[30] Foreign Application Priority Data

Oct. 13, 1987 [JP] Japan ..... 62-260093

[51] Int. Cl.[4] ..... F25B 27/00

[52] U.S. Cl. ..... 62/238.7; 62/324.1

[58] Field of Search ..... 62/79, 160, 238.6, 238.7, 62/324.1

[56] References Cited

U.S. PATENT DOCUMENTS

| | | | |
|---|---|---|---|
| 4,376,596 | 4/1988 | Iguchi et al. | 62/238.7 |
| 4,727,726 | 3/1988 | Mitani et al. | 62/238.6 |
| 4,727,727 | 3/1988 | Reedy | 62/238.6 |

FOREIGN PATENT DOCUMENTS 59-208363 11/1984 Japan .

*Primary Examiner*—Lloyd L. King

*Attorney, Agent, or Firm*—Cushman, Darby & Cushman

[57] ABSTRACT

A regenerative refrigeration cycle apparatus includes a refrigeration cycle circuit which is constructed by connecting a compressor, a four-way valve, an indoor heat exchanger, an expansion valve, and an outdoor heat exchanger. A regenerative unit for accumulating heat is arranged between the discharge side of the compressor and the four-way valve, and first and second heat exchangers are arranged in the regenerative unit together with a regenerative material. In a regenerating operation mode of the refrigeration cycle circuit, part of the refrigerant discharged from the compressor flows through the first heat exchanger, the indoor heat exchanger, and the outdoor heat exchanger, while the remaining part of the refrigerant flows through the second heat exchanger and the outdoor heat exchanger. The refrigerant discharged from the compressor is condensed in both the first and second heat exchangers, thereby heating the regenerative material.

17 Claims, 4 Drawing Sheets

REGENERATIVE REFRIGERATION CYCLE APPARATUS AND CONTROL METHOD THEREFOR

BACKGROUND OF THE INVENTION

1. Field of the Invention

The present invention relates to a regenerative refrigeration cycle apparatus having a regenerative tank, and a control method for the apparatus.

2. Description of the Related Art

In recent years, air conditioning systems having a refrigeration cycle and employing a regenerative tank have come into widespread use. The refrigeration cycle of a typical air conditioning system of this type generally comprises a variable-capacity compressor, a four-way valve, an indoor heat exchanger, a pressure reducing valve, and an outdoor heat exchanger, which are connected in succession. By switching the four-way valve to change the passage of a refrigerant, a cooling cycle or a heating cycle can be formed in succession. The regenerative tank, which includes a closed vessel, is situated between the four-way valve and the discharge side of the compressor. The vessel contains radiation- and absorption-side heat exchangers, along with a regenerative material which is subject to substantial variation in volume.

In the refrigeration cycle constructed in this manner, the heating operation takes place as follows:

Refrigerant discharged from the compressor flows successively through the radiation-side heat exchanger, the four-way valve, the indoor heat exchanger, the pressure reducing valve, the outdoor heat exchanger, and the four-way valve, and then returns to the compressor. As the refrigerant passes through the indoor heat exchanger, it condenses and releases condensation heat into a room, thereby producing a heating effect.

A regenerating operation is performed if the amount of heat accumulated in the regenerative material is reduced to a predetermined value or less, after the air conditioning system stopped for a long period of time. In this operation, the refrigerant flows in the same manner as in the heating operation, while a room fan, which is opposed to the indoor heat exchanger, is stopped. Accordingly, the refrigerant condenses only in the radiation-side heat exchanger, and not in the indoor-side heat exchanger. Thus, all the condensation heat is accumulated in the regenerative material.

The heat accumulated in the regenerative material, in this manner, is utilized for the start of the heating operation or the like. On the early morning of a cold winter day, for example, the compressor and other components of the refrigeration cycle are so cold that it takes much time to initiate the heating operation. Accordingly, heating start operation is performed in order that the heat from the regenerative material is absorbed to allow the refrigerant to be heated to a predetermined temperature in a relatively short period of time. As a result, the refrigerant discharged from the compressor flows through the radiation-side heat exchanger, four-way valve, indoor heat exchanger, and absorption-side heat exchanger, and then returns to the compressor. The refrigerant absorbs heat from the regenerative material in the absorption-side heat exchanger, thus increasing its temperature and evaporating. Thereupon, the refrigerant introduced into the compressor attains a fully high temperature despite the low outside air temperature, so that the heating effect can be obtained in a very short time after the start of the operation of the refrigeration cycle.

The heat accumulated in the regenerative material is also utilized in defrosting operation for defrosting the outdoor heat exchanger.

Constructed in this manner, however, the regenerative refrigeration cycle is subject to the following drawbacks.

In the regenerating operation, heat is accumulated in the regenerative material by condensing the refrigerant only in the radiation-side heat exchanger in the regenerative material. The condensation capacity of the radiation-side heat exchanger is much smaller than that of the indoor heat exchanger, and the condensation heat released from the former is less. Therefore, the efficiency of the regenerating operation is lower. Moreover, the radiation-side heat exchanger cannot fully condense the refrigerant by itself, so that the refrigerant is not fully condensed when it circulates through the refrigeration cycle. Therefore, the pressure on the suction side of the compressor increases at once to a high level. Accordingly, a high-pressure protection switch or protective control circuit of the refrigeration cycle is actuated so frequently that the compressor is started and stopped repeatedly. In consequence, the temperature of the refrigerant discharged from the compressor fails to be high enough, so that the regeneration temperature of the regenerative material is lowered, thus entailing the reduction of the efficiency of the regenerating operation.

SUMMARY OF THE INVENTION

The present invention has been contrived in consideration of these circumstances, and its object is to provide a regenerative refrigeration cycle apparatus capable of high-efficiency regenerating operation and of fully increasing the regeneration temperature of a regenerative material, and a control method for the apparatus.

In order to achieve the above object, a refrigerating cycle apparatus according to the present invention is provided with a by-pass circuit which leads part of a refrigerant discharged from a compressor to the suction side thereof through an absorption-side heat exchanger, which is disposed in a regenerative material. At the time of regenerating operation, the regenerative material is regenerated by condensing the refrigerant discharged from the compressor in both radiation- and absorption-side heat exchangers.

According to the present invention, therefore, the regeneration of the regenerative material can be achieved with high efficiency, and the refrigerant can be fully condensed even during the regenerating operation. Thus, the regeneration temperature of the regenerative material can be increased satisfactory.

In a control method according to the present invention, moreover, the temperature of the refrigerant led out from a second heat exchanger is detected. At the time of the regenerating operation, the condensation temperature of the refrigerant is detected from the aforesaid detected temperature, and the capacity of the compressor is adjusted in accordance with the condensation temperature. At the time of endothermic operation, the amount of heat accumulated in the regenerative material is detected from the detected temperature. When the accumulated heat amount is reduced below a predetermined value, the operation mode of a refrigeration cycle circuit is switched to regenerative heating operation.

BRIEF DESCRIPTION OF THE DRAWINGS

FIGS. 1 to 5 show a refrigeration cycle apparatus according to a first embodiment of the present invention, in which FIG. 1 is a circuit diagram showing an outline of the refrigeration cycle apparatus, FIG. 2 is a schematic view showing an arrangement of a sensor, FIG. 3 is a diagram showing the relationship between the changes in the refrigerant condensation temperature and the compressor speed, FIG. 4 is a diagram showing the change in the amount of accumulated heat during regenerating operation and the refrigerant temperature change, and FIG. 5 is a diagram showing the change in the amount of accumulated heat during endothermic operation and the refrigerant temperature change;

DETAILED DESCRIPTION OF THE PREFERRED EMBODIMENTS

Preferred embodiments of the present invention will now be described in detail with reference to the accompanying drawings.

Figure 1:
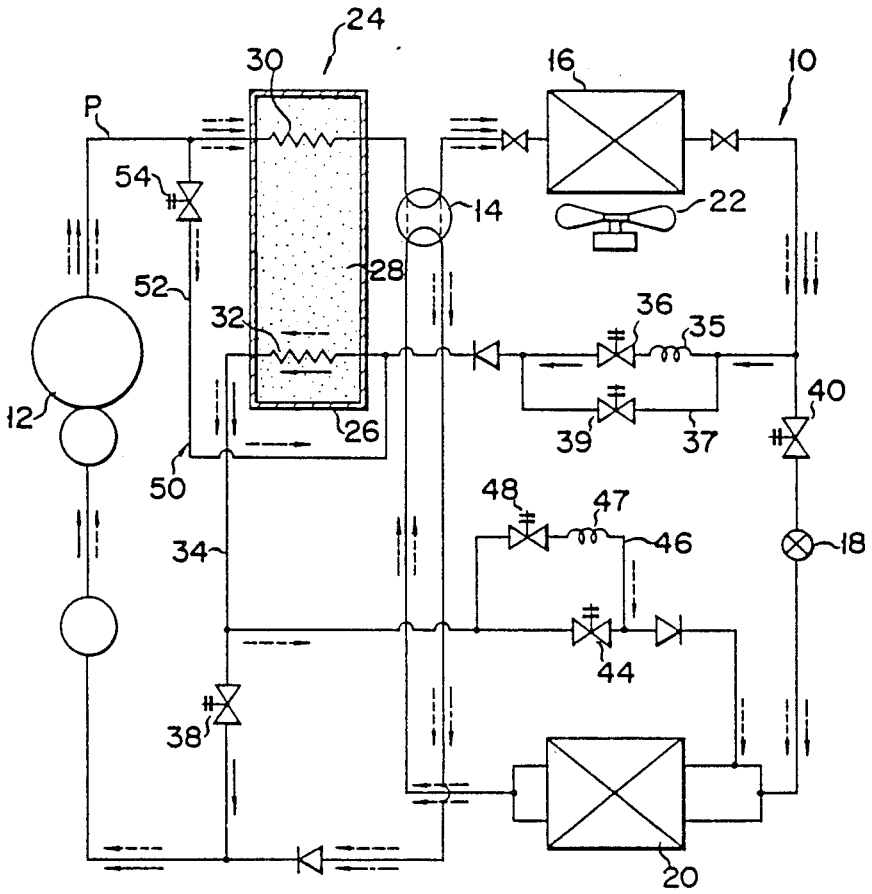

As is shown in FIG. 1, a refrigeration cycle apparatus comprises variable-capacity compressor 12 whose rotational frequency is controlled by means of an inverter circuit, four-way valve 14, indoor heat exchanger 16, expansion valve 18, and outdoor heat exchanger 20. Refrigeration cycle circuit 10 of a heat-pump type is formed by connecting these elements by means of refrigerant pipe P. Room fan 22 is opposed to indoor heat exchanger 16.

Regenerator unit 24 is arranged between the discharge side of compressor 12 and four-way valve 14. Unit 24 has closed vessel 26 containing regenerative material 28 which, essentially consisting of brine or paraffin, for example, is subject to substantial variation in volume. Vessel 26 also contains radiation-side heat exchanger 30 and absorption-side heat exchanger 32. Heat exchanger 30, which is located in refrigerant pipe P, is connected between the discharge side of compressor 12 and valve 14. Heat exchanger 32 is arranged in the middle of endothermic by-pass circuit 34. One end of circuit 34 is connected to that portion of pipe P between indoor heat exchanger 16 and expansion valve 18. The other end of circuit 34 is connected to that portion of pipe P between the suction side of compressor 12 and valve 14. Arranged in by-pass circuit 34 are capillary tube 35 and first two-way valve 36, which are situated between the one end of circuit 34 and absorption-side heat exchanger 32, and second two-way valve 38 between the other end of circuit 34 and heat exchanger 32. In circuit 34, moreover, first branch circuit 37 is connected in parallel with tube 35 and valve 36, and third two-way valve 39 is provided in the middle of circuit 37. Fourth two-way valve 40 is provided at that portion of refrigerant pipe P between the one end of by-pass circuit 34 and expansion valve 18.

Refrigeration cycle circuit 10 includes defrosting circuit 42 which is used in defrosting operation mentioned later. Circuit 42 extends from that portion of endothermic by-pass circuit 34 between absorption-side heat exchanger 32 and second valve 38, and connects with that portion of refrigerant pipe P between expansion valve 18 and outdoor heat exchanger 20. Fifth two-way valve 44 is arranged in defrosting circuit 42, and second branch circuit 46 is connected in parallel with valve 44. Circuit 46 includes capillary tube 47 and sixth two-way valve 48.

Refrigeration cycle circuit 10 further includes regenerative by-pass circuit 50, which leads part of a refrigerant, discharged from compressor 12, to outdoor heat exchanger 20 through absorption-side heat exchanger 32. Circuit 50 includes regenerative circuit 52, which extends from that portion of refrigerant pipe P between the discharge side of compressor 12 and radiation-side heat exchanger 30, and connects with that portion of endothermic by-pass circuit 34 between exchanger 32 and first branch circuit 37. Seventh two-way valve 54 is provided in the middle of circuit 52. By-pass circuit 50 is constructed by regenerative circuit 52, defrosting circuit 42, and that portion of by-pass circuit 34 situated between circuits 52 and 42. Thus, defrosting circuit 42 doubles as a second regenerative circuit of the present invention.

Figure 2:
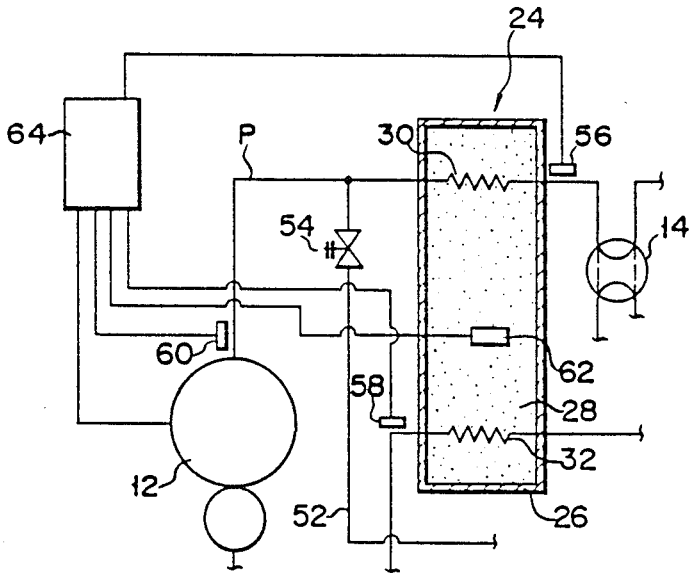

As is shown in FIG. 2, first and second sensors 56 and 58 are arranged in the vicinity of regenerator unit 24. Sensor 56 serves to detect the temperature of the refrigerant delivered from radiation-side heat exchanger 30, while sensor 58 is used to detect the temperature of the refrigerant from absorption-side heat exchanger 32. Third sensor 60 for detecting the temperature of the refrigerant discharged from compressor 12 is arranged on the discharge side of the compressor, and fourth sensor 62 for detecting the temperature of regenerative material 28 is located in vessel 26. Sensor 62 is situated wide apart from heat exchangers 30 and 32 so that it can detect the temperature of material 28 without being influenced by heat from exchangers 30 and 32.

Sensors 56 to 62 are electrically connected to control device 64, and deliver detection signals thereto. The control device, which includes an inverter circuit, controls the rotating speed of compressor 12 in response to the detection signals from the sensors. First to seventh two-way valves 36, 38, 39, 40, 44, 48 and 54 of refrigeration cycle circuit 10 are connected to control device 64 so that their switching operations are controlled thereby.

The operation of the refrigeration cycle apparatus constructed in this manner will now be described.

The refrigeration cycle apparatus can perform heating operation, cooling operation, regenerating operation, heating start operation, regenerative defrosting operation, and auxiliary defrosting operation by controlling the switching operations of the two-way valves and four-way valve 14, in the manner shown in the table below, by means of control device 64.

TABLE 2

| | Speed of the Compressor (Hz) | Four-way Valve 14 | First Valve 36 | Second Valve 38 | Third Valve 39 | Fourth Valve 40 | Fifth Valve 44 | Sixth and Seventh Valves | Indoor Fan |
|---|---|---|---|---|---|---|---|---|---|
| Cooling | 36~72 | OFF | OFF | ON | OFF | ON | OFF | OFF | ON(L) |
| Heating | 36~102 | ON | OFF | OFF | OFF | ON | OFF | OFF | ON(H) |

TABLE 2-continued

| | Speed of the Compressor (Hz) | Four-way Valve 14 | First Valve 36 | Second Valve 38 | Third Valve 39 | Fourth Valve 40 | Fifth Valve 44 | Sixth and Seventh Valves | Indoor Fan |
|---|---|---|---|---|---|---|---|---|---|
| Regenerating | 40 | ON | OFF | OFF | OFF | ON | OFF | ON | OFF |
| Heating Start | 36~83 | ON | ON | ON | OFF | OFF | OFF | OFF | ON(H) |
| Regenerative Defrosting | 36~78 | ON | OFF | OFF | ON | OFF | ON | OFF | OFF |
| Auxiliary Defrosting | 78 | OFF | OFF | ON | OFF | OFF | OFF | OFF | OFF |

In starting the cooling operation, four-way valve 14 is switched off, and second and fourth valves 38 and 40, among the first to seventh valves, are opened, while the other two-way valves are closed. Thereupon, the refrigerant discharged from compressor 12 flows through radiation-side heat exchanger 30, four-way valve 14, outdoor heat exchanger 20, expansion valve 18, indoor heat exchanger 16, valve 14, and compressor 12, in the order named. In the meantime, room fan 22 is being operated. Thus, the refrigerant is evaporated in heat exchanger 16, so that it absorbs latent evaporation heat from the room air, thereby producing a cooling effect.

In starting the heating operation, four-way valve 14 is switched on, and only fourth two-way valve 40, among the first to seventh valves, is opened, while the other two-way valves are closed. Thereupon, the refrigerant discharged from compressor 12 flows through radiation-side heat exchanger 30, four-way valve 14, indoor heat exchanger 16, expansion valve 18, outdoor heat exchanger 20, valve 14, and compressor 12, in the order named, as indicated by dashed-line arrows in FIG. 1. In the meantime, fan 22 is being operated. Thus, the refrigerant condenses in heat exchanger 16, so that it releases condensation heat into a room, thereby producing a heating effect.

In executing the heating start operation on the early morning of a winter day, four-way valve 14 is switched on, and first and second two-way valves 36 and 38 are opened, while the other two-way valves are closed. Thereupon, the refrigerant discharged from compressor 12 flows through radiation-side heat exchanger 30, four-way valve 14, indoor heat exchanger 16, capillary tube 35, first valve 36, absorption-side heat exchanger 32, second valve 38, and compressor 12, in the order named, as indicated by full-line arrows in FIG. 1. In the meantime, fan 22 is being operated at high-speed. In this manner, the refrigerant removes heat from regenerative material 28 and evaporates as it flows through exchanger 32, and is delivered at high temperature to the suction side of compressor 12. Despite the low outside air temperature, therefore, compressor 12 can operate efficiently, so that refrigeration cycle circuit 10 can effect the heating operation in a very short time after start of the operation.

In executing the regenerating operation to provide for the aforementioned heating start operation, four-way valve 14 is switched on, and fourth, sixth, and seventh two-way valves 40, 48 and 54 are opened, while the other two-way valves are closed. Thereupon, part of the refrigerant discharged from compressor 12 flows through radiation-side heat exchanger 30, four-way valve 14, indoor heat exchanger 16, expansion valve 18, outdoor heat exchanger 20, and valve 14, and then returns to compressor 12, as indicated by broken-line arrows in FIG. 1. The remaining part of the refrigerant returns to compressor 12 after flowing through seventh two-way valve 54, absorption-side heat exchanger 32, sixth two-way valve 48, capillary tube 47, outdoor heat exchanger 20, and four-way valve 14. In the meantime, the drive of room fan 22 is stopped.

Consequently, the refrigerant discharged from compressor 12 is condensed in both radiation- and absorption-side heat exchangers 30 and 32 in regenerator unit 24. In doing this, it releases condensation heat, thereby heating regenerative material 28. Thus, heat is accumulated in material 28.

In executing the regenerative defrosting operation for defrosting the outdoor heat exchanger 20 during the regenerating operation, four-way valve 14 is switched on, and third and fifth two-way valves 39 and 44 are opened, while the other two-way valves are closed. Thereupon, the refrigerant discharged from compressor 12 flows through radiation-side heat exchanger 30, four-way valve 14, indoor heat exchanger 16, third two-way valve 39, absorption-side heat exchanger 32, fifth two-way valve 44, outdoor heat exchanger 20, and valve 14, and then returns to compressor 12. In this case, the refrigerant flows, under high temperature and pressure conditions, into exchanger 20, whereupon it condenses. In doing this, the refrigerant releases condensation heat, thereby defrosting exchanger 20.

Outdoor heat exchanger 20 can be also defrosted by the auxiliary defrosting operation. In this case, the individual two-way valves are controlled in the same manner as in the cooling operation, provided that only second two-way valve 38 is opened. Thereupon, the refrigerant discharged from compressor 12 flows through radiation-side heat exchanger 30, four-way valve 14, outdoor heat exchanger 20, expansion valve 18, indoor heat exchanger 16, and valve 14, and then returns to compressor 12. In this case, the refrigerant flows, under high temperature and pressure conditions, into exchanger 20, whereupon it condenses. In doing this, the refrigerant releases condensation heat, thereby defrosting exchanger 20. Since second two-way valve 38 is open, the refrigerant remaining in endothermic by-pass circuit 34 is led to the low-pressure side of refrigerating cycle circuit 10, i.e., the suction side of compressor 12, and serves for the defrosting operation.

According to the refrigeration cycle apparatus constructed in this manner, the refrigerant is condensed in both radiation- and absorption-side heat exchangers 30 and 32 of regenerator unit 24 during the regenerating operation. Therefore, the amount of condensation of the refrigerant is larger than in a case such that the refrigerant is condensed in only one of the heat exchangers. Thus, regenerative material 28 of regenerator unit 24 can be heated efficiently. At the same time, the refrigerant condenses fully in unit 24, so that the suction pressure of compressor 12 can be prevented from increasing excessively, and the compressor can be prevented from stopping frequently. Accordingly, the duration period of the operation of compressor 12 is lengthened, and the refrigerant can be fully increased in temperature when it is supplied from the compressor to regenerator unit 24. As a result, the regeneration temperature of regenerative material 28 can be raised fully, and the regenerating operation can be performed efficiently. Since material 28 can be heated by means of both radiation- and absorption-side heat exchangers 30 and 32, moreover, its temperature distribution is uniform. Thus, the heat accumulated in the regenerative material can be extracted efficiently as required.

In the regenerating operation, the operation of compressor 12 is controlled as follows.

Figure 3:
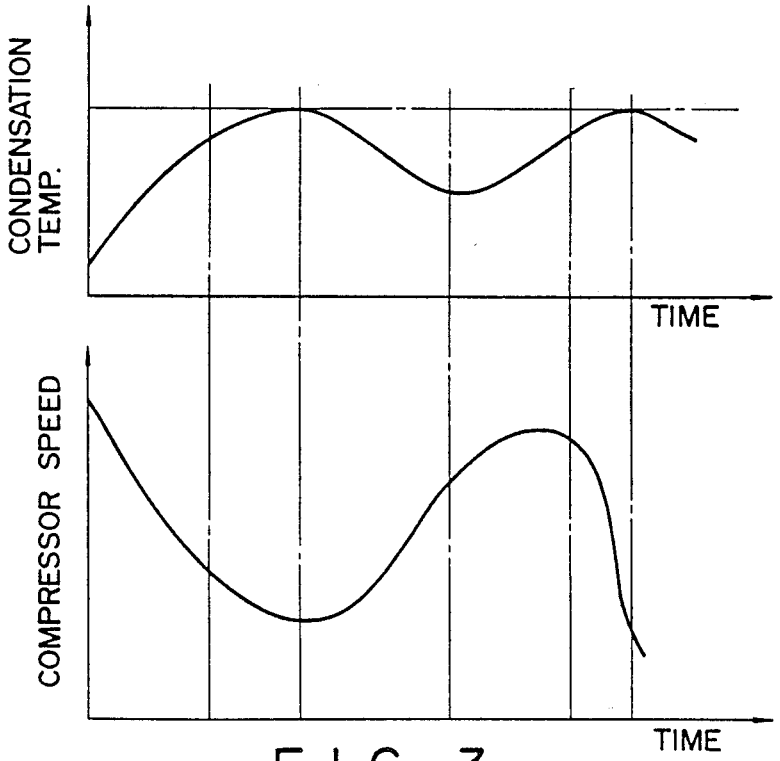

The condensation temperature of the refrigerant condensed in the radiation- and absorption-side heat exchangers 30 and 32 is detected by means of first and second sensors 56 and 58. The detection signals from these sensors are delivered to control device 64, which controls the rotating speed of compressor 12 in response to the detection signals. If the condensation temperature of the refrigerant gets higher than a predetermined level, as is shown in FIG. 3, control device 64 lowers the compressor speed, thereby reducing the capacity of the compressor. If the condensation temperature is lowered, on the other hand, device 64 increases the compressor speed, thereby enhancing the compressor capacity. Thus, the refrigerant is controlled so that the values for its condensing conditions should not exceed set values (e.g., 58° C. and 28 kg/cm$^2$G for R-22). In this manner, compressor 12 and regenerator unit 24 can be prevented from being excessively heated or pressurized, and therefore, their safety can be maintained. Moreover, the compressor capacity can never increase unduly, thus ensuring energy-saving operation.

Compressor 12 may be controlled in response to a detection signal indicative of the pressure of the refrigerant detected instead of detecting the condensation temperature of the refrigerant by means of first and second sensors 56 and 58.

The temperature of the refrigerant discharged from compressor 12 is detected by means of third sensor 60. Control device 64 controls the operation of compressor 12 in response to the detection signal from sensor 60. More specifically, the temperature of the discharged refrigerant unduly increases in case of overload operation of the refrigeration cycle apparatus or gas leakage, for example. In such a case, first and second sensors 56 and 58 may sometimes fail to detect the undue increase of the refrigerant temperature, so that compressor 12, regenerator unit 24, etc. may possibly be damaged by heat. If regenerative material 28 expands in excess of the capacity of regenerative vessel 26, the vessel may possibly be subject to leakage or breakage. To prevent this, control device 16 lowers the rotating speed of compressor 12 to reduce its capacity when the temperature of the refrigerant discharged from the compressor exceeds a predetermined value. Thus, the possibility of the aforesaid awkward situations can be eliminated. Since the maximum expanded volume of the regenerative material can be limited, regenerative vessel 26 can be designed for the minimum necessary capacity.

In the regenerating operation, the amount of heat accumulated in regenerative material 28 is detected by means of fourth sensor 62. Since sensor 62 is situated wide apart from both radiation- and absorption-side heat exchangers 30 and 32, as mentioned before, it can detect the temperature of nothing but the regenerative material.

Figure 4:
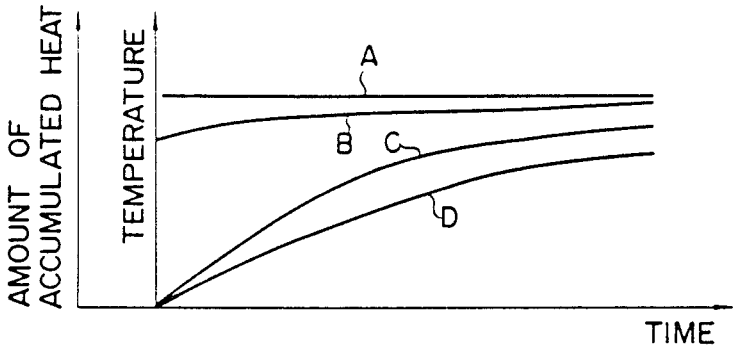

Regenerative material 28, which has great specific heat and latent heat, is low in thermal conductivity and fluidity. During the regenerating operation, various temperatures and the amount of accumulated heat vary as is shown in FIG. 4. In FIG. 4, straight line A represents the transition of the temperature of the refrigerant at the inlet of regenerator unit 24, and curves B and C represent the transitions of the outlet temperature of the refrigerant and the temperature of regenerative material 28, respectively. As indicated by curve D, the amount of heat accumulated in the regenerative material slowly changes substantially in proportion to the temperature variation of the material. As seen from this, it is most advisable to detect the temperature of regenerative material 28 itself by means of fourth sensor 62, in order to measure the amount of accumulated heat during the regenerating operation. When the accumulated heat amount attains a predetermined value, control device 64 stops the operation of compressor 12 or lowers the capacity of the compressor.

The amount of heat accumulated in regenerative material 28 during the regenerative heating operation can be also detected by means of fourth sensor 62.

Figure 5:
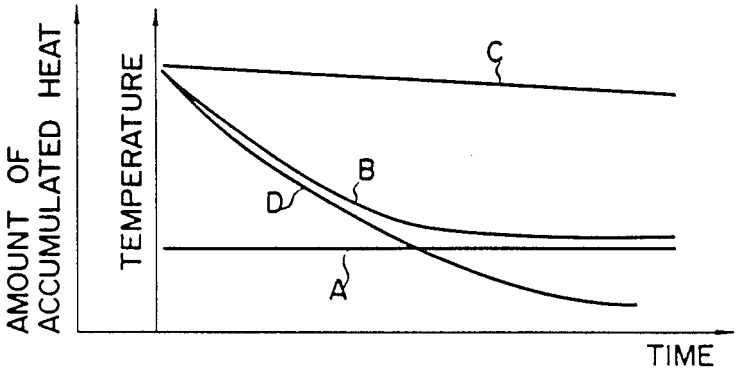

The amount of heat accumulated in material 28 during the endothermic operation, on the other hand, is detected by means of second sensor 58. During the endothermic operation, the various temperatures and the amount of accumulated heat vary as is shown in FIG. 5. Since the low-temperature refrigerant flows through absorption-side heat exchanger 32 of regenerator unit 24, the inlet temperature of the refrigerant is low, as indicated by straight line A in FIG. 5, and the outlet temperature of the refrigerant lowers gradually, as indicated by curve B. In contrast with this, the temperature of regenerative material 28 in those regions at distances from radiation- and absorption-side heat exchangers 30 and 32 lower relatively slowly, as indicated by straight line C. The temperature drop of the regenerative material becomes sharper as the spot of measurement approaches the absorption-side heat exchanger. Thus, the temperature change of regenerative material 28 varies considerably, depending on the measurement spot of the regenerative material. It is therefore difficult to obtain an accurate amount of heat accumulated in regenerative material 28 by the temperature detection by means of fourth sensor 62. The amount of heat accumulated in material 28 varies as indicated by curve D in FIG. 5, and the temperature of the refrigerant at the outlet of absorption-side heat exchanger 32 varies substantially in proportion to the accumulated heat amount, as indicated by curve B. Thus, it may be understood that there is a correlation between the outlet temperature of the refrigerant and the regeneration temperature of regenerative material 28, obtained during the endothermic operation. Although material 28 has low thermal conductivity, therefore, the amount of heat accumulated in the material can be seized accurately by detecting the refrigerant temperature at the outlet of heat exchanger 32 by means of second sensor 58. When the accumulated heat amount is reduced to a predetermined value or less, control device 64 switches the operation mode of refrigeration cycle circuit 10 from the heating start operation to the regenerative heating operation.

When the operation is stopped, the amount of heat accumulated in regenerative material 28 can be seized by detecting the material temperature by means of fourth sensor 62. When the accumulated heat amount is reduced to a predetermined value or less, control device 64 actuates refrigeration cycle circuit 10 to start the regenerating operation.

Figure 6:
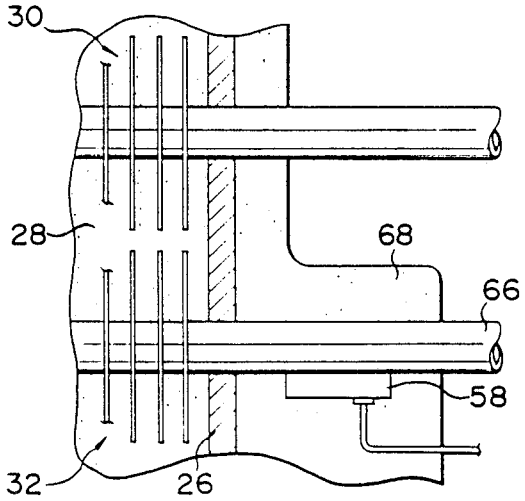
FIG. 6 is a schematic view showing a first modification of the arrangement of the sensor.

As is shown in FIG. 6, second sensor 58 may be fixed to the outer peripheral surface of refrigerant pipe 66, which constitutes absorption-side heat exchanger 34, and be enclosed in adiabatic member 68 which covers the outer surface of regenerative vessel 26. In this case, the heat from regenerative material 28 is transmitted accurately to second sensor 58 through pipe 66 which has high thermal conductivity. Since sensor 58 is enclosed in the adiabatic member, moreover, it is hardly influenced by the outside air temperature. Thus, second sensor 58 can accurately detect the temperature of material 28 during the heating operation, in which the refrigerant condenses only in radiation-side heat exchanger 30, or when the refrigerating cycle apparatus is not in operation. In consequence, the amount of heat accumulated in regenerative material 28 can be grasped accurately in response to the detection signal from sensor 58. During the endothermic operation, furthermore, sensor 58 detects the outlet temperature of the refrigerant, and the amount of heat accumulated in material 28 can be seized in response to the detection signal from sensor 58, as in the case of the embodiment described above.

Figure 7:
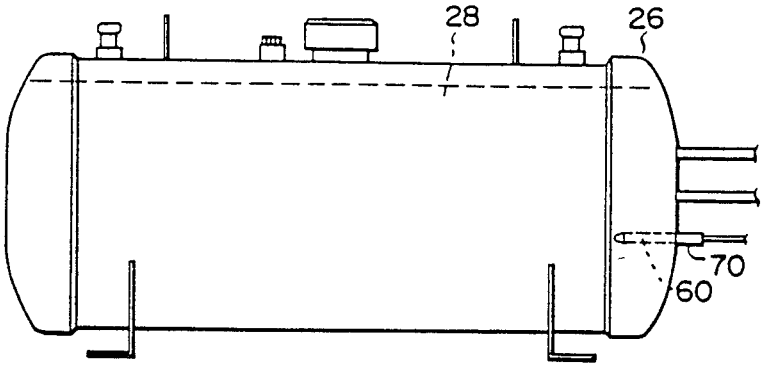
FIG. 7 is a side view showing the relative positions of a regenerator unit and the sensor.

As is shown in FIG. 7, third sensor 60, which is used to detect the temperature of the refrigerant discharged from compressor 12, may be disposed in refrigerant pipe 70 which connects with the compressor and regenerative vessel 26. In this case, sensor 60 can detect the temperature of the refrigerant discharged from compressor 12 when the compressor is operating. When the compressor is stopped, sensor 60 can detect the temperature of regenerative material 28.

It is to be understood that the present invention is not limited to the embodiment described above, and that various changes and modifications may be effected therein by one skilled in the art without departing from the scope or spirit of the invention.

Figure 8:
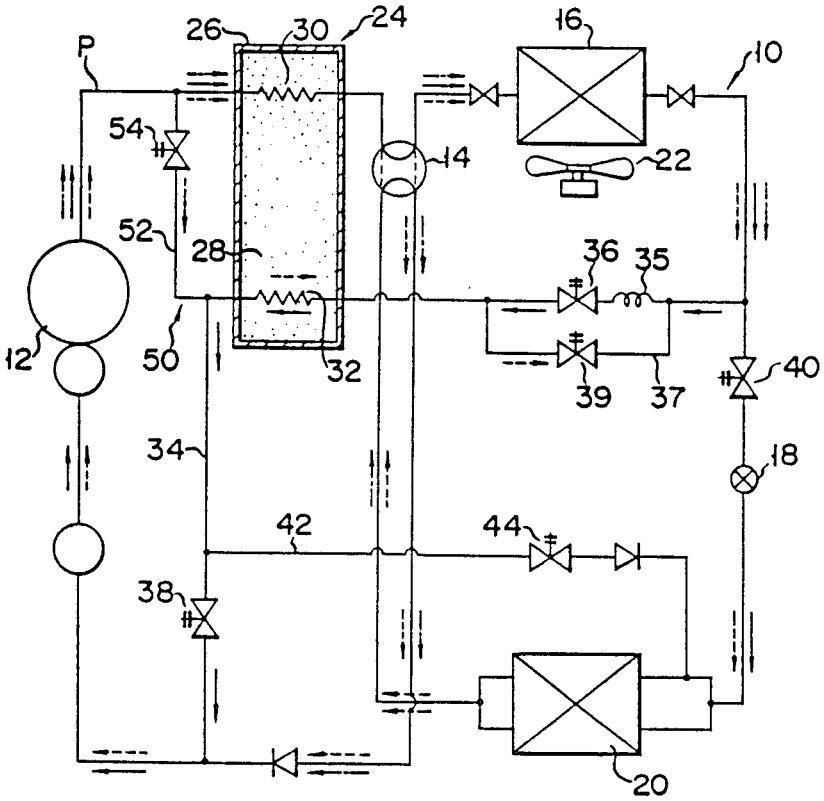
FIG. 8 shows a refrigeration cycle apparatus according to a second embodiment of the invention.

As is shown in FIG. 8, for example, regenerative circuit 52 may be designed so as to extend from that portion of refrigerant pipe P between the discharge side of compressor 12 and radiation-side heat exchanger 30, and to connect with that portion of endothermic bypass circuit 34 between absorption-side heat exchanger 32 and second two-way valve 38. In starting the regenerating operation, according to this second embodiment, four-way valve 14 is switched on, and third, fourth, and seventh two-way valves 39, 40 and 54 are opened, while the other two-way valves ar closed. Thereupon, part of the refrigerant discharged from compressor 12 flows through radiation-side heat exchanger 30, four-way valve 14, indoor heat exchanger 16, fourth two-way valve 40, expansion valve 18, outdoor heat exchanger 20, and valve 14, and then returns to compressor 12. The remaining part of the refrigerant returns to compressor 12 after flowing through seventh two-way valve 54, absorption side heat exchanger 32, third two-way valve 39, fourth two-way valve 40, expansion valve 18, outdoor heat exchanger 20, and four-way valve 14. During the regenerating operation, therefore, the refrigerant can be condensed in both radiation- and absorption-side heat exchangers 30 and 32, and the same function or effect of the first embodiment can be obtained. According to the second embodiment, moreover, sixth two-way valve 48, capillary tube 47, and branch circuit 46, which are used in the first embodiment, may be omitted, so that the apparatus can be simpler in construction and lower in manufacturing cost.

The other arrangements and operation of the apparatus of the second embodiment are the same as those of the first embodiment, and a detailed description thereof is omitted herein.

What is claimed is:

1. A regenerative refrigeration cycle apparatus comprising:

a refrigeration cycle circuit for circulating a refrigerant, said refrigeration cycle circuit including a compressor, a four-way valve connected to the discharge side and the suction side of the compressor, an indoor heat exchanger connected to the four-way valve, an outdoor heat exchanger connected to the four-way valve, and pressure reducing means connected between the indoor and outdoor heat exchangers;

regenerative means arranged in the refrigerating cycle circuit, said regenerative means including a regenerative material for accumulating heat, a first heat exchanger located in the regenerative material and connected between the discharge side of the compressor and the four-way valve, and a second heat exchanger located in the regenerative material, said refrigeration cycle circuit further including an endothermic by-pass circuit extending from between the indoor heat exchanger and the pressure reducing means so as to lead the refrigerant, past through the indoor heat exchanger, to the suction side of the compressor via the second heat exchanger, a first valve for opening and closing the by-pass circuit, a regenerative by-pass circuit extending from between the discharge side of the compressor in the first heat exchanger so as to lead part of the refrigerant discharged from the compressor, to the outdoor heat exchanger via the second heat exchanger, and a second valve for opening the regenerative bypass circuit; and control means for controlling the operation of the first and second valves, said control means establishing by closing the first and second valves, a heating operation mode wherein the refrigerant discharged from the compressor is caused to flow through the first heat exchanger and the indoor heat exchanger, so that it is condensed in the indoor heat exchanger; to establish, by closing an opening the first and second valves respectively, a regenerating operating mode wherein the refrigerant discharged from the compressor is caused to flow through the first and second heat exchangers, so that the refrigerant is condensed in the first and second heat exchangers thereby accumulating the condensation heat in the regenerative material; and to establish, the opening and closing the first and second valves, respectively, and endothermic operation mode wherein the refrigerant passed through the first heat exchanger and the indoor exchanger is caused to flow through the second heat exchanger, so that the refrigerant is evaporated in the second heat exchanger.

2. An apparatus according to claim 1, wherein said regenerative by-pass circuit includes a first regenerative circuit for leading part of the refrigerant, discharged from the compressor, to the second heat exchanger, and a second regenerative circuit for leading the refrigerant passed through the second heat exchanger to the outdoor heat exchanger, said first valve is located at that portion of the endothermic by-pass circuit between the indoor heat exchanger and the second heat exchanger, and said second valve is located in the first regenerative circuit.

3. An apparatus according to claim 2, wherein said refrigeration cycle circuit includes a third valve located between the pressure reducing means and the endothermic by-pass circuit and connected to the control means, said third valve being adapted to be opened in the regenerative heating operation mode and the regenerating operation mode, and to be closed in the endothermic operation mode.

4. An apparatus according to claim 3, wherein said first regenerative circuit extends from between the discharge side of the compressor and the first heat exchanger and connects with that portion of the endothermic by-pass circuit between the second heat exchanger and the first valve, said second regenerative circuit extends from that portion of the endothermic by-pass circuit between the second heat exchanger and the suction side of the compressor and is connected between the pressure reducing means and the outdoor heat exchanger, and said refrigeration cycle circuit includes a fourth valve located at that portion of the endothermic by-pass circuit between the suction side of the compressor and the second regenerative circuit, and a fifth valve provided in the second regenerative circuit, said fourth valve being connected to the control means and adapted to be opened and closed in the endothermic operation mode and the regenerating operation mode, respectively, and said fifth valve being connected to the control means and adapted to be closed and opened in the endothermic operation mode and the regenerating operation, respectively.

5. An apparatus according to claim 4, wherein said refrigeration cycle circuit includes second pressure reducing means located at that portion of the endothermic by-pass circuit between the indoor-side heat exchanger and the second heat exchanger, for decompressing the refrigerant flowing through the endothermic by-pass circuit in the endothermic operation mode, and third pressure reducing means arranged in the second regenerative circuit, for decompressing the refrigerant flowing through the second regenerative circuit in the regenerating operation mode.

6. An apparatus according to claim 5, wherein said refrigeration cycle circuit includes a first branch circuit connected to the endothermic by-pass circuit, in parallel with the first valve and the second pressure reducing means, a second branch circuit connected to the second regenerative circuit, in parallel with the fifth valve and the third pressure reducing means, a sixth valve arranged in the first branch circuit and connected to the control means, and a seventh valve provided in the second branch circuit and connected to the control means; and said control means closes the first to fifth valves and opens the sixth and seventh valves, thereby establishing a regenerative defrosting operation mode wherein the refrigerant discharged from the compressor is led to the outdoor heat exchanger through the first heat exchanger, the indoor heat exchanger, and the second heat exchanger.

7. An apparatus according to claim 3, wherein said refrigeration cycle circuit includes a fourth valve located at that portion of the endothermic by-pass circuit between the second heat exchanger and the suction side of the compressor, a branch circuit connected to the endothermic by-pass circuit, in parallel with the first valve, and a fifth valve located in the branch circuit; said first regenerative circuit extends from between the discharge side of the compressor and the first heat exchanger and connects with that portion of the endothermic by-pass circuit between the second heat exchanger and the fourth valve; and said second regenerative circuit is constructed by the branch circuit and that portion of the endothermic by-pass circuit which extends between the second heat exchanger and the pressure reducing means, said fourth valve being connected to the control means and adapted to be opened in the endothermic operation mode and closed in the regenerative heating operation mode and the regenerating operation mode, and said fifth valve being adapted to be opened in the regenerating operation mode and closed in the regenerative heating operation mode and the endothermic operation mode.

8. An apparatus according to claim 7, wherein said refrigeration cycle circuit includes a defrosting circuit extending from that portion of the endothermic by-pass circuit between the second heat exchanger and the fourth valve, and connected between the pressure reducing means and the outdoor-side heat exchanger, a sixth valve located in the defrosting circuit and connected to the control means; and said control means opens the fifth and sixth valves and closes the first to fourth gate valves, thereby establishing a regenerative defrosting operation mode wherein the refrigerant discharged from the compressor is led to the outdoor heat exchanger through the first heat exchanger, the indoor heat exchanger, and the second heat exchanger.

9. An apparatus according to claim 1, wherein said compressor is a variable-capacity compressor whose capacity is adjusted by means of the control means.

10. An apparatus according to claim 9, wherein said control means includes a sensor for detecting the temperature of the refrigerant passed through the second heat exchanger, and changes the capacity of the compressor in accordance with the temperature detected by the sensor in the regenerating operation mode and the endothermic operation mode.

11. An apparatus according to claim 10, wherein said regenerative means includes a vessel containing the regenerative material and the first and second heat exchanger, a pipe constituting the second heat exchanger, and a heat insulating material covering the outer surface of the vessel; and said sensor is fixed to the pipe and covered by the heat insulating material, and detects the temperature of the regenerative material through the medium of the pipe, in the regenerative heating operation mode and when the operation of the refrigeration cycle circuit is stopped.

12. An apparatus according to claim 1, wherein said control means includes a sensor for detecting the temperature of the refrigerant on the discharge side of the compressor, and adjusts the capacity of the compressor in accordance with the temperature detected by the sensor.

13. An apparatus according to claim 1, wherein said control means includes a sensor for detecting the temperature of the regenerative material, and adjusts the capacity of the compressor, in accordance with the temperature detected by the sensor, in the regenerating operation mode.

14. An apparatus according to claim 13, wherein said sensor is situated in the regenerative material at a distance from each of the first and second heat exchangers, to prevent the sensor from being influenced by heat emanating from the first and second heat exchangers.

15. A method of controlling a regenerative refrigeration cycle apparatus which comprises a refrigeration circuit for circulating a refrigerant, said refrigeration cycle circuit including a variable-capacity compressor, a four-way valve connected to the discharge side and the suction side of the compressor, an indoor heat exchanger connected to the four-way valve, an outdoor heat exchanger connected to the four-way valve, and pressure reducing means connected between the indoor and outdoor heat exchangers; regenerative means arranged in the refrigeration cycle circuit, said regenerative means including a regenerative material for accumulating heat, a first heat exchanger located in the regenerative material and connected between the discharge side of the compressor and the four-way valve, and a second heat exchanger located in the regenerative material, said regenerative refrigeration cycle apparatus being capable of performing a regenerative heating operation wherein the refrigerant discharged from the compressor is condensed in the first heat exchanger and the indoor heat exchanger, a regenerating operation wherein the refrigerant discharged from the compressor is condensed in the first and second heat exchangers, so that the heat of the condensation is accumulated in the regenerative material, and an endothermic operation wherein the refrigerant discharged from the compressor is evaporated in the second heat exchanger, so that the heat accumulated in the regenerative material is absorbed by the refrigerant, said control method comprising the steps of:

detecting the temperature of the refrigerant led out from the second heat exchanger;

detecting the condensation temperature of the refrigerant from said detected temperature, at the time of the regenerating operation, and adjusting the capacity of the compressor in accordance with the detected condensation temperature; and detecting the amount of accumulated heat in the regenerative material from said detected temperature, at the time of the endothermic operation, and switching the operation mode of the refrigeration cycle circuit to the regenerative heating operation when the amount of accumulated heat is reduced to a predetermined value or less.

16. A method according to claim 15, which further comprises the steps of detecting the temperature of the refrigerant discharged from the compressor, and adjusting the capacity of the compressor to prevent the temperature of the discharged refrigerant from exceeding a predetermined value.

17. A method according to claim 15, which further comprises the steps of detecting the temperature of the regenerative material, and adjusting the capacity of the compressor so that the detected temperature of the regenerative material is at a predetermined value, at the time of the regenerating operation.

* * * * *

UNITED STATES PATENT AND TRADEMARK OFFICE

CERTIFICATE OF CORRECTION

PATENT NO. : 4,869,074

DATED : September 26, 1989

INVENTOR(S) : Takao HOSHI, Keiichi MORITA

It is certified that error appears in the above-identified patent and that said Letters Patent is hereby corrected as shown below:

On the title page:

Please delete

"[30] Foreign Application Priority Data

Oct. 13, 1987 [JP] Japan.....62-260093"

and insert therefor

--[30] Foreign Application Priority Data

Oct. 15, 1987 [JP] Japan.....62-260093--

Signed and Sealed this

Eighth Day of January, 1991

*Attest:*

*Attesting Officer*

HARRY F. MANBECK, JR.

*Commissioner of Patents and Trademarks*